US010501254B2

(12) United States Patent
Wood et al.

(10) Patent No.: US 10,501,254 B2
(45) Date of Patent: Dec. 10, 2019

(54) THERMALLY INSULATED PACKAGE

(71) Applicant: Peli BioThermal Limited, Leighton Buzzard, Bedfordshire (GB)

(72) Inventors: Richard Wood, Bedfordshire (GB); Sean Austerberry, Bedfordshire (GB); Kevin Valentine, Bedfordshire (GB); Karen Adams, Bedfordshire (GB)

(73) Assignee: Peli BioThermal Limited, Bedfordshire (GB)

( * ) Notice: Subject to any disclaimer, the term of this patent is extended or adjusted under 35 U.S.C. 154(b) by 667 days.

(21) Appl. No.: 14/566,532

(22) Filed: Dec. 10, 2014

(65) Prior Publication Data

US 2015/0166244 A1 Jun. 18, 2015

(30) Foreign Application Priority Data

Dec. 13, 2013 (GB) ..... 1322111.4

(51) Int. Cl.

| | |
|---|---|
| ***B65D 81/38*** | (2006.01) |
| ***B65D 81/18*** | (2006.01) |
| ***F25D 3/08*** | (2006.01) |
| ***B31B 50/74*** | (2017.01) |

(52) U.S. Cl.

CPC ..... *B65D 81/18* (2013.01); *B31B 50/74* (2017.08); *B65D 81/383* (2013.01); *B65D 81/3816* (2013.01); *B65D 81/3827* (2013.01); *B65D 81/3834* (2013.01); *F25D 3/08* (2013.01); *F25D 2201/14* (2013.01); *F25D 2303/085* (2013.01); *F25D 2303/0843* (2013.01); *F25D 2303/0844* (2013.01); *F25D 2303/0845* (2013.01); *F25D 2303/08221* (2013.01)

(58) Field of Classification Search

USPC ..... 62/371

See application file for complete search history.

(56) References Cited

U.S. PATENT DOCUMENTS

| | | | | |
|---|---|---|---|---|
| 5,570,588 | A | 11/1996 | Lowe | |
| 5,897,932 | A | 4/1999 | McGarth et al. | |
| 6,266,972 | B1 * | 7/2001 | Bostic | F25D 3/06 62/371 |
| 7,412,846 | B2 | 8/2008 | Sekiya et al. | |
| 7,607,542 | B1 | 10/2009 | Hsieh | |

(Continued)

FOREIGN PATENT DOCUMENTS

| | | |
|---|---|---|
| AU | 2009200930 | 9/2010 |
| CN | 202743596 | 2/2013 |

(Continued)

OTHER PUBLICATIONS

European Office Action dated Feb. 2, 2016, from related EU application No. 14197636.5.

(Continued)

*Primary Examiner* — Christopher R Zerphey
*Assistant Examiner* — Paul S Schwarzenberg
(74) *Attorney, Agent, or Firm* — Foley & Lardner LLP

(57) ABSTRACT

A thermally insulating package comprises an outer shell (6) formed from a foam insulating material, a plurality of vacuum insulated panels (12) removably received on the walls of the outer shell (6) and a plurality of phase change material panels (18) arranged within the vacuum insulated panels (12) to define a payload space.

16 Claims, 13 Drawing Sheets

(56) References Cited

U.S. PATENT DOCUMENTS

| | | | | |
|---|---|---|---|---|
| 2002/0134962 | A1 | 9/2002 | Romero | |
| 2003/0082357 | A1 | 5/2003 | Gokay et al. | |
| 2004/0069789 | A1* | 4/2004 | Ohno | A47J 41/022 220/592.2 |
| 2005/0189404 | A1* | 9/2005 | Xiaohai | B65D 81/3862 229/103.11 |
| 2007/0186577 | A1* | 8/2007 | Goncharko | B65D 81/3858 62/371 |
| 2008/0135564 | A1 | 6/2008 | Romero | |
| 2009/0078708 | A1 | 3/2009 | Williams | |
| 2011/0147391 | A1 | 6/2011 | Corder et al. | |
| 2011/0226783 | A1 | 9/2011 | Sawaki | |
| 2011/0248038 | A1 | 10/2011 | Mayer | |
| 2013/0020309 | A1 | 1/2013 | Tattam et al. | |
| 2013/0228583 | A1 | 9/2013 | Mayer | |
| 2013/0340467 | A1* | 12/2013 | Kiedaisch | F25D 3/00 62/457.2 |

FOREIGN PATENT DOCUMENTS

| | | | |
|---|---|---|---|
| DE | 10058565 | 2/2002 | |
| DE | 10206109 | 6/2003 | |
| EP | 2 221 569 | 8/2010 | |
| EP | 2 374 443 | 10/2011 | |
| EP | 2 700 891 | 2/2014 | |
| EP | 2 883 811 | 6/2015 | |
| EP | 2 883 812 | 6/2015 | |
| GB | 2 465 376 | 5/2010 | |
| GB | 2 645 022 | 10/2013 | |
| WO | WO-03/030769 | 4/2003 | |
| WO | WO-2008/133374 | 11/2008 | |
| WO | WO-2008/137883 | 11/2008 | |
| WO | WO 2008133374 A1 * | 11/2008 | F25D 3/08 |
| WO | WO-2012/094333 | 7/2012 | |

OTHER PUBLICATIONS

Examination Report dated May 4, 2016, from related GB application No. 1322111.4.

U.S. Office Action dated Jul. 26, 2016, from related U.S. Appl. No. 14/566,514.

Chinese Office Action dated Oct. 25, 2016, from related application No. 201410778889.6.

U.S. Office Action dated Nov. 25, 2016, from related U.S. Appl. No. 14/566,514.

Chinese Office Action dated Sep. 5, 2016, from related application No. 201410778241.9.

Extended European Search Report dated Apr. 28, 2015, from related European Patent Application No. 14197636.5.

Extended European Search Report dated May 7, 2015, from related European Patent Application No. 14197628.2.

GB Search Report dated Apr. 1, 2014, from related GB Patent Application No. 1322111.4.

GB Search Report dated Jul. 28, 2014, from related GB Patent Application No. 1322111.4.

Singaporean Search Report and Written Opinion, dated Jun. 2, 2015, from related Singaporean Patent Application No. 10201408331Y.

Singaporean Search Report and Written Opinion, dated Sep. 17, 2015, from related Singaporean Patent Application No. 10201408334S.

Examination Report dated Mar. 10, 2016, from related Singaporean application No. 10201408334S.

Notice of Eligibility dated May 17, 2016, from related Singaporean application No. 10201408334S.

Supplementary Search Report dated May 19, 2016, from related Singaporean application No. 10201408334S.

U.S. Notice of Allowance dated Jan. 17, 2018, from U.S. Appl. No. 14/566,514.

* cited by examiner

THERMALLY INSULATED PACKAGE

CROSS-REFERENCE TO RELATED PATENT APPLICATIONS

This application claims priority from GB Application No. 1322111.4, filed Dec. 13, 2013, incorporated herein by reference in its entirety.

BACKGROUND

Field

The present invention relates to a thermally insulated package.

Related Art

Thermally insulated packages are widely used in the transportation of temperature sensitive goods, for example pharmaceuticals, biological samples, vaccines and the like. Typically the product must be maintained within predetermined temperature ranges, for example 2-8° C., 15 to 25° C. or less than −20° C., over relatively long time periods, for example 48-120 hours. Various forms of such packaging are known using a variety of temperature control media (for example phase change materials) and insulation. An example of such a product is described in EP-A-2221569. Such packaging, while providing good temperature control characteristics, does not lend itself to multiple use, and may prove to be relatively expensive.

SUMMARY

The present invention seeks to provide a temperature sensitive package which provides good temperature control, but which is compact, robust and potentially less expensive than existing comparable products.

From a first aspect, the invention provides a thermally insulating package comprising: an outer shell formed from a foam insulating material; a plurality of vacuum insulated panels removably received in pockets formed in the walls of the outer shell; and a plurality of phase change material (PCM) panels arranged within the vacuum insulated panels to define a payload space.

Thus in accordance with this aspect of the invention, an array of PCM panels defines a payload space, and two layers of insulating material are provided around the PCM panels, namely a layer of vacuum insulated panels and a layer of foam insulation which removably receives the vacuum insulated panels. This arrangement provides a compact, thermally efficient package which may be easily constructed. The removable mounting of the vacuum insulated panels allows the panels easily to be removed and reused or replaced, the foam insulation acting to protect the vacuum insulated panels in use. This is important as if punctured, the vacuum insulated panels lose the majority of their thermal insulating properties.

The above construction may also be used with other materials inserted in the pockets of the outer shell. For example to provide an insulating structure having improved thermal insulating properties compared to a shell of an expanded foam material, the pockets may accommodate inserts of other insulating materials, particularly inserts of a material having a lower coefficient of thermal conductivity than that of the material of the outer shell.

From a further broad aspect, therefore, the invention provides a thermally insulating package comprising: an outer shell having a first coefficient of thermal conductivity; a plurality of insert panels having a second coefficient of thermal conductivity which is lower than the first coefficient of thermal conductivity received in pockets formed in the walls of the outer shell; and a plurality of phase change material (PCM) panels arranged within the panels to define a payload space.

Thus by appropriate choice of materials for the outer shell and the insert panels, a desired thermal conductivity of the package insulation may be achieved.

The insert panel may be constructed simply as a block of material having the desired thermal conductivity, and could, for example, be simply cut from a sheet of such material to an appropriate size for insertion into the pockets.

The insert panel could of course be a vacuum insulated panel as discussed above, as this will, as is recognised by the skilled person, have a much lower coefficient of thermal conductivity than a foam material. However, in other embodiments, the insert panel is not a vacuum insulated panel.

The outer shell may be formed from any suitable foam material such as expanded polystyrene (EPS), graphite impregnated EPS (e.g. Neopor®), EPS with a polyethylene additive (e.g. Arcel®), polyurethane (PUR) or polypropylene. The skilled person will be aware of other suitable foam materials. Any of these materials would be suitable for use with a vacuum insulated panel insert.

As an alternative to a vacuum insulated panel, where the outer shell is formed from EPS, graphite impregnated EPS or EPS with a polyethylene additive, the insert panel may be PUR, or a Nano porous material, for example a polyurethane based aerogel material (for example Slentite®). Where the outer shell is a PUR, then the Nano porous material may be suitable. Of course the skilled person will be able to choose appropriate combinations of materials to provide a desired thermal conductivity.

In some embodiments, the inserts may be a mixture of materials or constructions.

In order to facilitate assembly and integrity of the package, the vacuum insulated panels or insert panels may be dimensioned such that they are received with a push fit with the pockets.

In a preferred arrangement, the outer shell comprises a main body having a base wall and four or more side walls upstanding from the base wall, and a lid removably received on the main body to provide access to the interior of the package.

The main body part may be formed as a unitary body, but in some embodiments, it may be formed in two or more parts, for example where a larger package is required. The main body portion may therefore comprise a base part and one or more annular parts stacked onto the base part.

The vacuum insulated panel or insert panel receiving pockets may be provided in just some of the main body walls and/or in the lid, but in the preferred embodiment pockets are formed in all the walls and the lid. More than one pocket may be provided in one, more or all of the walls and lid. For example an array of panels may be mounted in the walls or lid. This may prove useful in larger packages.

The pockets formed in the walls of the outer shell advantageously open towards the payload space. Also, for ease of assembly and construction, the pockets formed in the side walls of the package may have an open upper end to allow easy installation of the vacuum insulated panels therein.

This is in itself considered to be an advantageous feature, so from a further aspect, the invention provides a thermally insulated package comprising a plurality of side walls formed of an insulating foam material, one or more of said side walls having a pocket having an open upper end, and a vacuum insulated panel, or a panel of a material having a coefficient of thermal conductivity less than that of the foam material mounted in the pocket.

The respective pockets, and thus the vacuum insulated panel or other panels received in the pockets, may be separated by corner columns formed in the outer shell.

The vacuum insulated or other insert panels may be of any convenient shape, but will typically be hexahedral, for example cuboidal, for example square or rectangular cuboidal.

In order further to protect the vacuum insulated or other insert panels, a separate protection element is preferably arranged between the vacuum insulated or other insert panels and the adjacent PCM panel.

Preferably the protection element is formed from a sheet material, for example a corrugated board or corrugated plastics material.

One or both faces of the protection element board may be provided with a reflective, for example a foil for example a metallised film, coating or layer.

One or both faces of the protection element board may also or alternatively be provided with a waterproof coating to mitigate damage from moisture that may accumulate during use.

In one embodiment, a reflective coating or layer may be provided on one side of the board and a waterproof coating or layer provided on the other.

In a particularly preferred embodiment, a metallised film may be provided on a waterproof plastics film to provide both reflective and waterproofing properties.

Preferably the protection element extends around the vacuum insulated or other insert panel to protect all the exposed faces of the vacuum insulated or other insert panel not covered by the outer shell.

Thus, in an arrangement such as discussed above in which a vacuum insulated or other insert panel is received in an open topped pocket in the outer shell wall (and will therefore have an exposed top edge), it is preferred that the protection element also extends over the exposed top edge of the vacuum insulated or other insert panel.

In a particularly preferred arrangement, the protection element is formed from a folded board material having a first panel for covering a first face of the vacuum insulated or other insert panel, a second panel hingedly attached to the first panel for covering a top edge of the vacuum insulated or other insert panel and a third panel hingedly attached to the second panel for at least partially covering a second face of the vacuum insulated or other insert panel opposite the first face. This arrangement is advantageous in that the protection element may also be used to handle the vacuum insulated or other insert panel prior to its placing in the outer shell, as the user will be able to grip the vacuum insulated or other insert panel between the first and third panels. This reduces the likelihood of the vacuum insulated panel or other insert being damaged during installation.

In the preferred embodiment, the third panel does not cover the entire second surface but only a region thereof.

The pocket formed in the wall of the outer shell may have a recess to accommodate the third panel such that the rear face of the vacuum insulated or other insert panel may sit closely against the back surface of the pocket.

The concept of providing a separate protection element which can also be used in handling a vacuum insulated or other insert panel is itself considered to be novel and inventive, so from a further aspect, the invention provides, in combination, a vacuum insulated or other insert panel and a protection element therefor, said protection element comprising a folded sheet material having a first panel for covering a first face of the vacuum insulated or other insert panel, a second panel hingedly attached to the first panel for covering a top edge of the vacuum insulated or other insert panel and a third panel hingedly attached to the second panel for at least partially covering a second face of the vacuum insulated or other insert panel opposite the first face.

In a preferred embodiment, the protection element may be wider than the vacuum insulated or other insert panel so as to project beyond the edges of the vacuum insulated or other insert panel.

Most preferably the pockets formed in the side walls of the outer shell are provided with respective slots to receive the projecting portion of the protection element. This adds a level of retention for the vacuum insulated or other insert panel in the side wall, apart from any press fit which may exist.

This slot may also serve an additional or alternative purpose, as will be described further below.

The PCM panel used in the packaging of the invention may take any convenient form. For example, it may take the form of a frustum of a right pyramid, as disclosed in EP-A-2221569. However, such shapes are expensive to produce and unnecessarily complicated. In a preferred embodiment of the invention, therefore, the PCM panel may comprise a phase change material sealed within a foil or film pouch and having a flange extending at least partially around the periphery of the panel. Such panels are much simpler and cheaper to manufacture than the aforementioned shaped panels.

The peripheral flange may be used to assist in locating the PCM panel in the package. Specifically, the flange may be received in a slot a formed in a side wall of the outer shell. This slot may be the same slot as discussed above which receives the vacuum insulated or other insert panel protection element (if present), or a separate, stand-alone slot. It is particularly advantageous to have a slot which retains both the flange of the PCM panel and a peripheral portion of a vacuum insulated or other insert panel protection element.

From a further broad aspect, the invention provides a thermally insulated package comprising a thermally insulating shell of a foam material, one or more walls of said shell comprising an open topped pocket formed in a wall thereof, at least one side edge of said pocket having a slot formed therein.

The PCM panel may therefore be arranged within the pocket and may be selectively removable from the pocket through an open top end of the pocket, with the peripheral flange of the PCM received in the slot or slots when the PCM panel is arranged within the pocket.

Each pocket may have a pair of side edges that face each other, and a slot be provided in each of those side edges.

Each pocket may have a bottom side edge that faces an open top end of the pocket, and a slot be provided slot in the bottom side edge.

In certain embodiments, the flange may be provided on just one pair of opposed edges of the PCM panel. However, in other embodiments, the flange may extend along a single side of the PCM panel, any plurality of sides of the PCM panel or all sides of the PCM panel.

The PCM panel may be constructed from a plurality of PCM panel elements which may be mounted to a common support, for example a sheet of board or plastics material, for example corrugated cardboard or corrugated plastics. The support may include a flange to receive the flanges of the individual PCM panel elements and therefore be used to engage the slot in the outer shell.

The flanges of the individual PCM panels may be received by the support board flange by arranging the PCM panels on the support board with the flanges of the PCM panels on and in contact with the flange of the support board. In particular embodiments, the flanges of the PCM panels are connected to the flange of the support board with any suitable connecting material for example an adhesive, staples, clips, snap connectors or other connectors. In other embodiments, the flanges of the individual PCM panels may be molded or thermally bonded to the support board flange or received in pockets or slots formed in the support board flange.

The flange of the PCM panel or panels is preferably formed generally co-planar with one face of the panel. Most preferably that face of the PCM panel or panels is arranged facing the vacuum insulated or other insert panel.

The PCM panel or panels may be arranged to project out from the pocket(s) formed in the walls of the outer insulating shell. Alternatively, the PCM panel or panels may be such as to be generally flush with the surface of the pocket, or be recessed slightly therein.

The flange of the PCM panel may also act to help retain the PCM panel in a wall pocket of the package, for example in the lid of the package, as when pushed into the pocket, the flange will be folded back to provide an outwardly (with respect to the base of the pocket) pointing edge which will tend to engage the side wall of the pocket and thereby assist in retaining the PCM panel.

From a further aspect, therefore, the invention provides a thermally insulating package comprising a wall having a pocket formed therein, said pocket receiving a PCM panel having a peripheral flange which upon insertion into the pocket folds to provide an outwardly directed edge engaging one or more side walls of the pocket.

In such a structure, the PCM may have the various features discussed in the above paragraphs.

The payload may be placed directly in the space defined by the PCM panels. Preferably, however, it is received within an inner container, for example a cardboard box which is received in the payload space.

The inner container may be foil, for example metallised foil faced. It may, additionally or alternatively be provided with a waterproof, e.g. plastics, coating. A metallised plastics film may provide both functions. Alternatively, the inner box may be made from a corrugated plastics material The inner container may be dimensioned so as to engage the outer shell, thereby to assist in locating the payload. For example, the inner container may engage the corner posts defined between adjacent side wall pockets. The inwardly pointing edge of the pockets may be provided with a chamfer or groove to receive a corner of the inner container.

The outer shell may be received within an outer container, for example a corrugated board container or a corrugated plastics, for example Correx®, container, for shipping, to provide some protection to the outer shell.

BRIEF DESCRIPTION OF THE DRAWINGS

A preferred embodiment of the invention will now be described by way of example only with reference to the accompanying drawings in which:

With reference to FIG. 1, a package 2 in accordance with the invention is illustrated in an exploded view.

DETAILED DESCRIPTION

Figure 1:
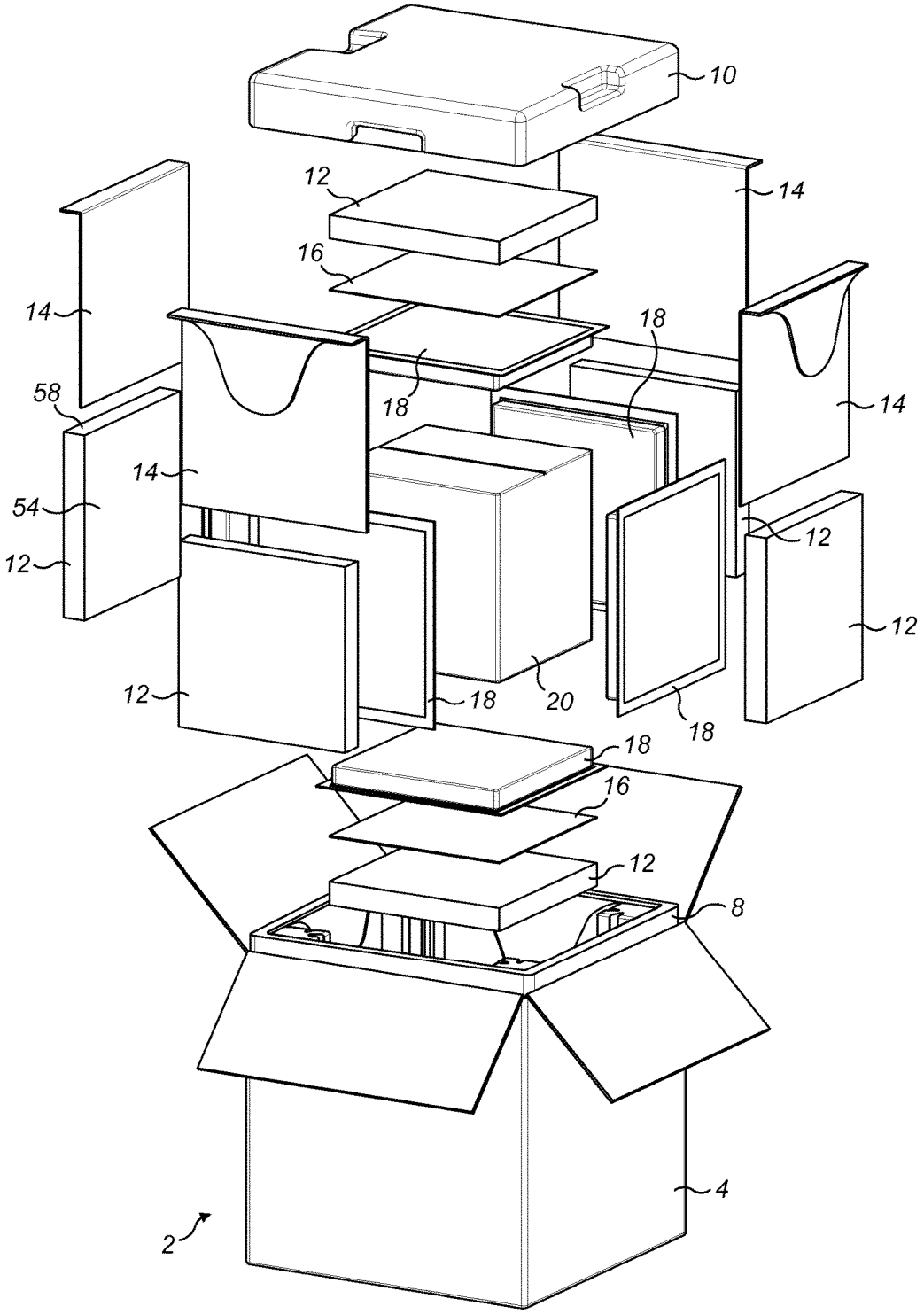
FIG. 1 is an exploded view of a package in accordance with the invention.

The package 2 comprises an external container 4, in this case a simple corrugated cardboard box. Inside the external container 4 is provided an outer shell 6 (shown in cross section in FIG. 6) comprising a main body 8 (shown in FIG. 4) and a lid 10. The main body 8 and the lid 10 are moulded components formed from an insulating foam material such as expanded polystyrene (EPS), graphite impregnated EPS (e.g. Neopor®), EPS with a polyethylene additive (e.g. Arcel®), polyurethane (PUR) or polypropylene. Preferably the lid 10 and the main body 8 are made from the same foam material.

Arranged within the outer shell are arrays of vacuum insulated panels 12, vacuum insulated panel protection elements 14, 16, PCM panels 18 and a payload container 20.

Figure 4:
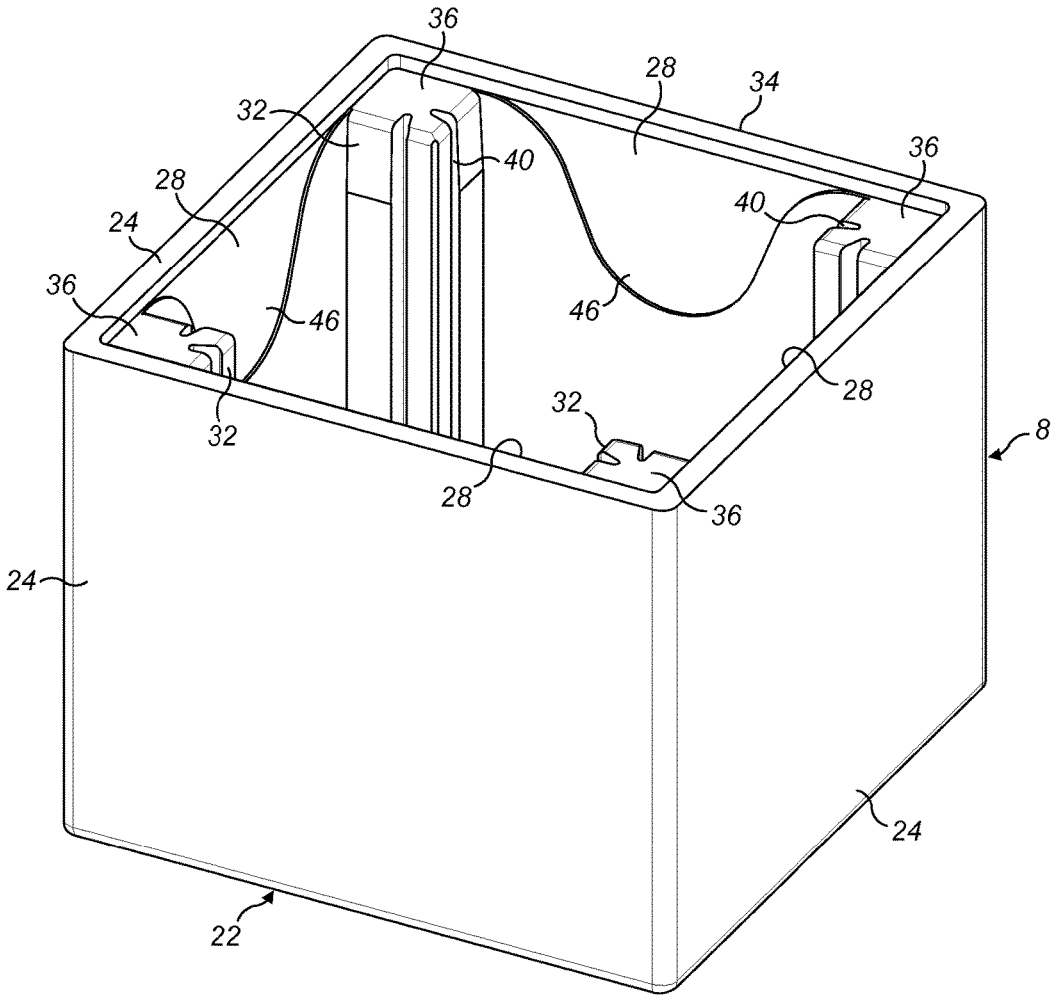
FIG. 4 shows a perspective view of the outer shell of the package of FIG. 1.
Figure 5:
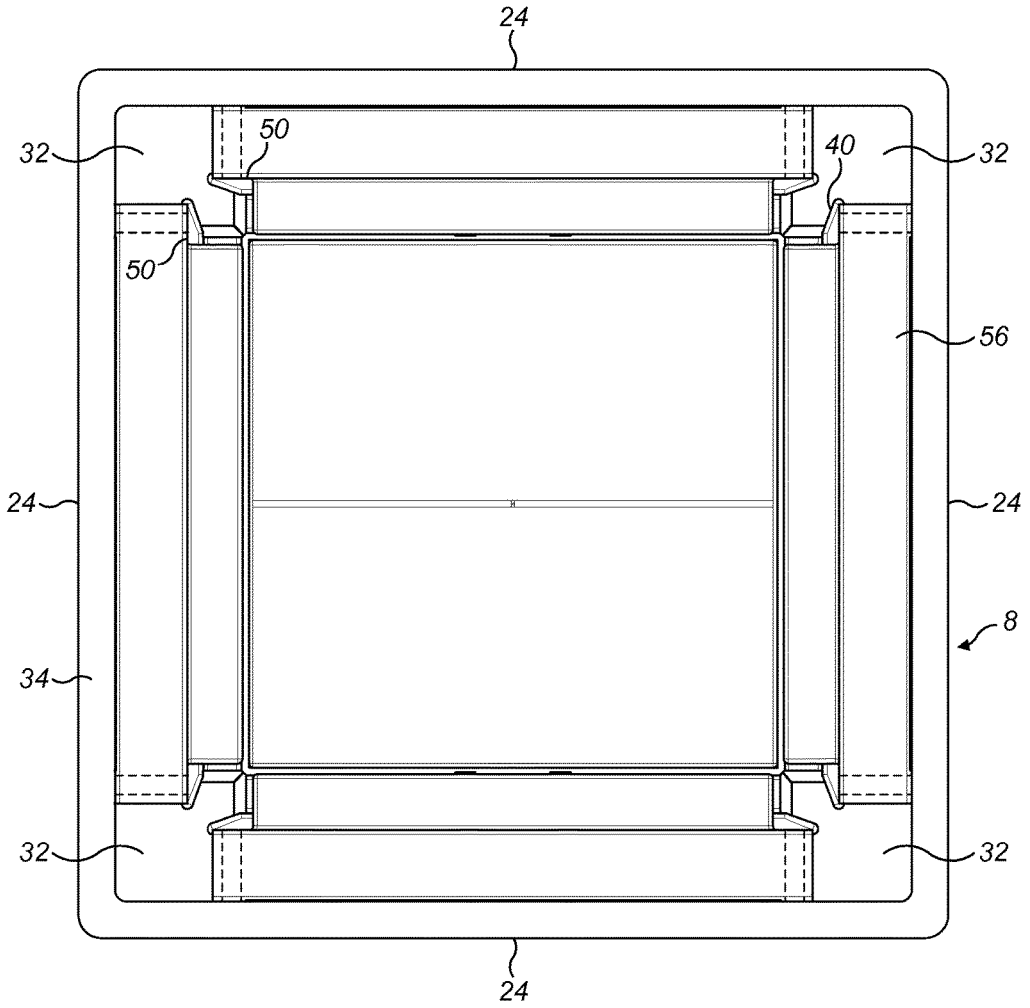
FIG. 5 is a top plan view of the outer shell shown in FIG. 4.
Figure 6:
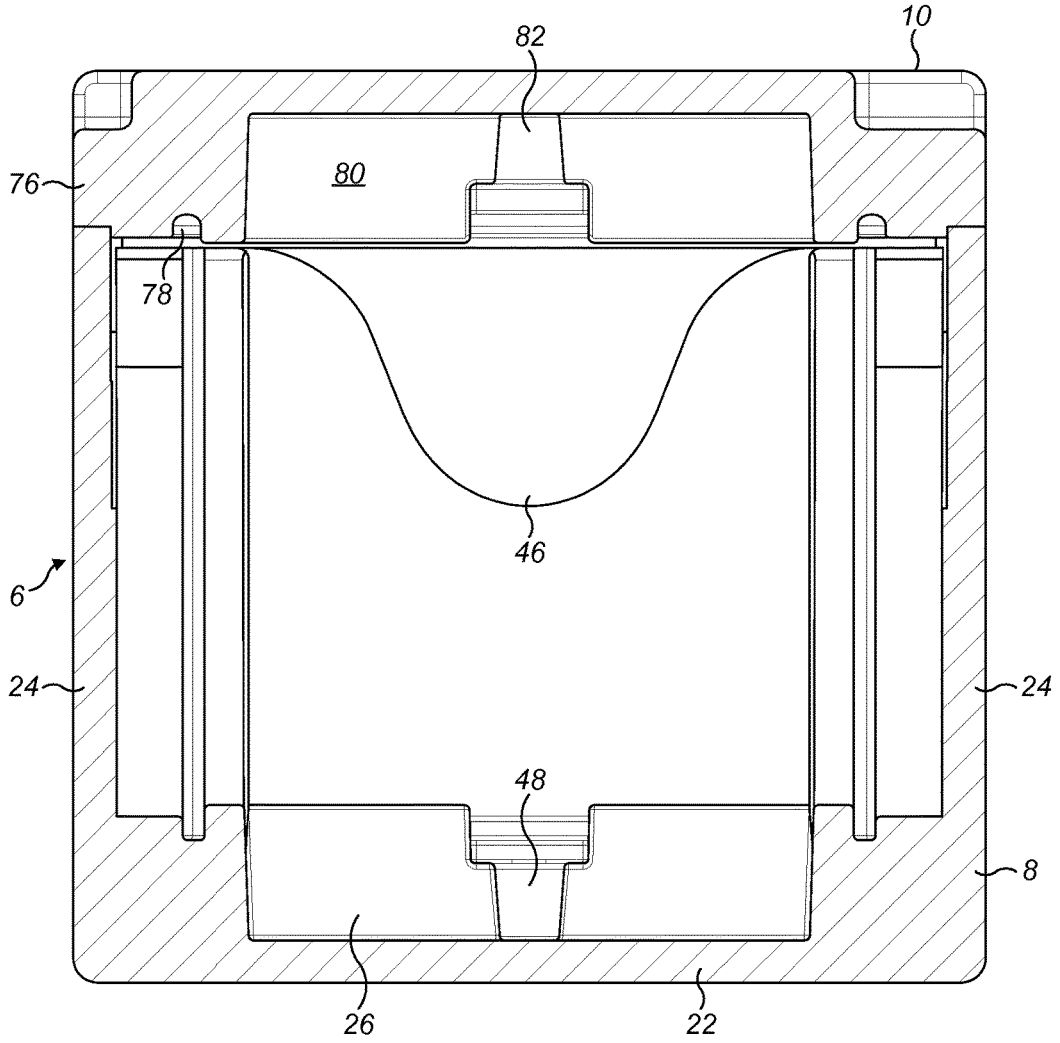
FIG. 6 is a vertical cross section of the assembled outer shell and lid of the package of FIG. 1 with the internal components of the package removed.

As can best be seen from FIGS. 4 to 6, main body 8 is a unitary body and comprises a base wall 22 and four upstanding side walls 24. The base wall 22 is formed with a central, square sectioned, upwardly open pocket 26. Each side wall 24 is provided with a pocket 28. The top 30 and inwardly facing side of each side wall pocket 28 is open. The adjacent side wall pockets 28 are separated by generally square section corner posts 32 formed in the body of the outer shell. The pockets 26, 28 are preferably integrally moulded into the main body 8. A lip 34 projects upwardly around the upper edge of the main body 8, with platforms 36 being formed atop the corner posts 22.

Figure 7:
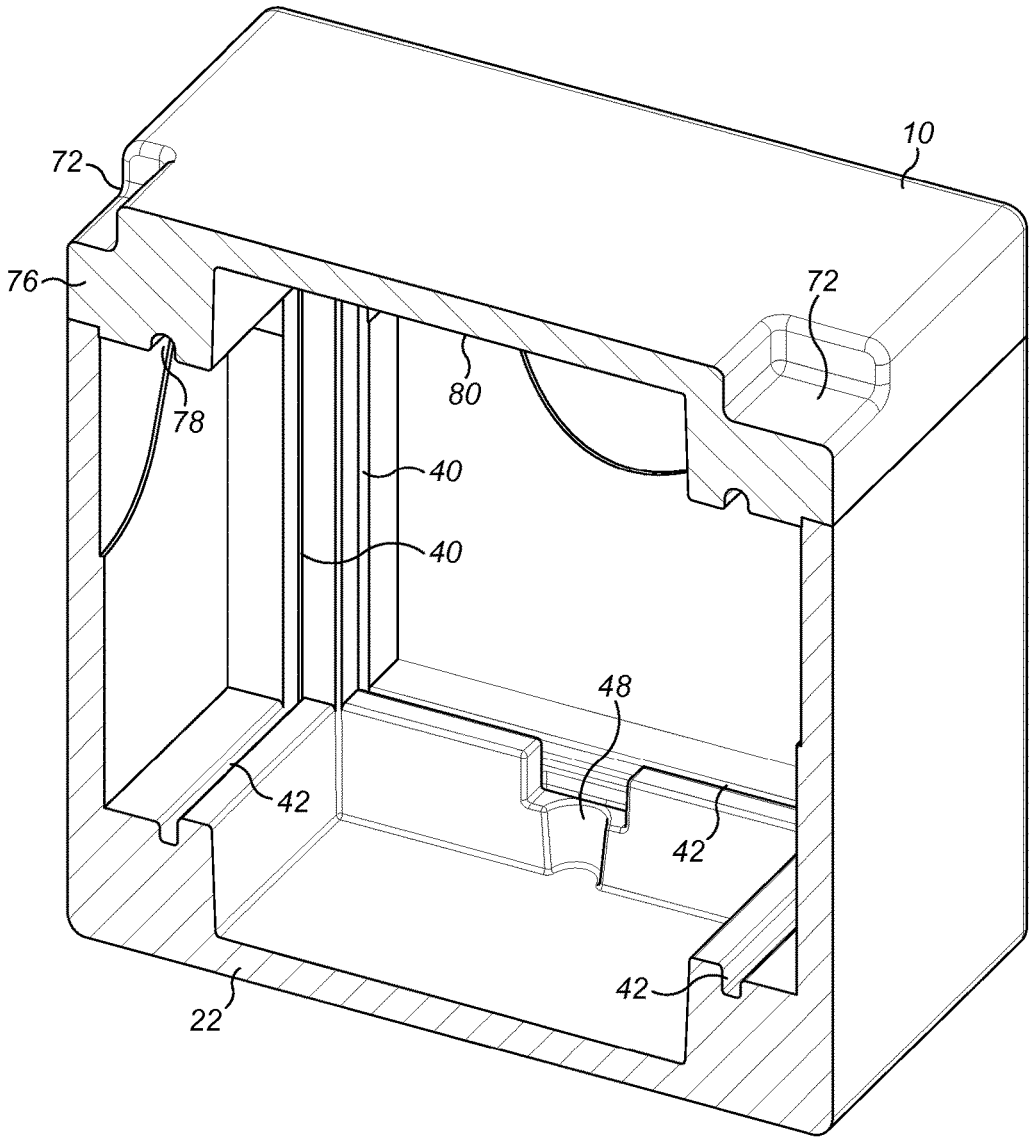
FIG. 7 is a perspective cross sectional view of the package.

The opposed sides 38 of each side wall pocket 28 defined by the corner posts 32 are provided with slots 40 along their length. As best seen in FIG. 7, the base wall 22 is also provided with respective slots 42 aligned with the side wall slots 40 to form a generally U-shaped slot in each side wall 24. In addition, the back surface 44 of each side wall pocket 28 is formed with a shallow recess 46. The base wall 22 is also provided on one or more sides, preferably on two opposed sides, with recesses 48. The purpose of these various formations will be described further below.

As will be best understood from FIG. 1, the base wall pocket 26 receives, from the bottom up, a square vacuum insulated panel 12, a square vacuum insulated panel protection element 16 and a square PCM panel 18. Although shown as square in this embodiment, the respective panels may be other shapes, for example rectangular, in other embodiments.

The vacuum insulated panel 12 is preferably a slight push fit in the pocket 26 to firmly locate the panel 12. The vacuum insulated panel 12 is, as is are the other vacuum insulated panels 12 in the package, of a standard industry construction, namely an evacuated porous core for example of fumed silica encapsulated in an airtight film, more particularly a metallised foil film. The various vacuum insulated panels 12 are all of the same shape and size in this embodiment, but depending on the shape of the payload, the vacuum insulated panels 12 may be of different shapes and sizes.

As illustrated in FIG. 1, the vacuum insulated panel protection element 16 is a square section of corrugated board material, for example E flute (2 mm) or B flute (3 mm) corrugated board material which may be coated on one or preferably both faces with a metallised foil film and/or a waterproof coating. This will protect the vacuum insulated panel 12 from the PCM panel 18 above.

The PCM panel 18 in this embodiment is formed from a PCM material encapsulated in a plastics film. The particular PCM used will depend on the desired temperature for the payload, but in this embodiment it is tetradecane. This material has a phase change point of 4.5° C. making it suitable for a payload requiring a temperature range of 2-8° C. Other phase change materials, such as mixtures of salt hydrates, have phase change points ranging, depending on their composition, from −20° C. to +20° C.

Figure 2:
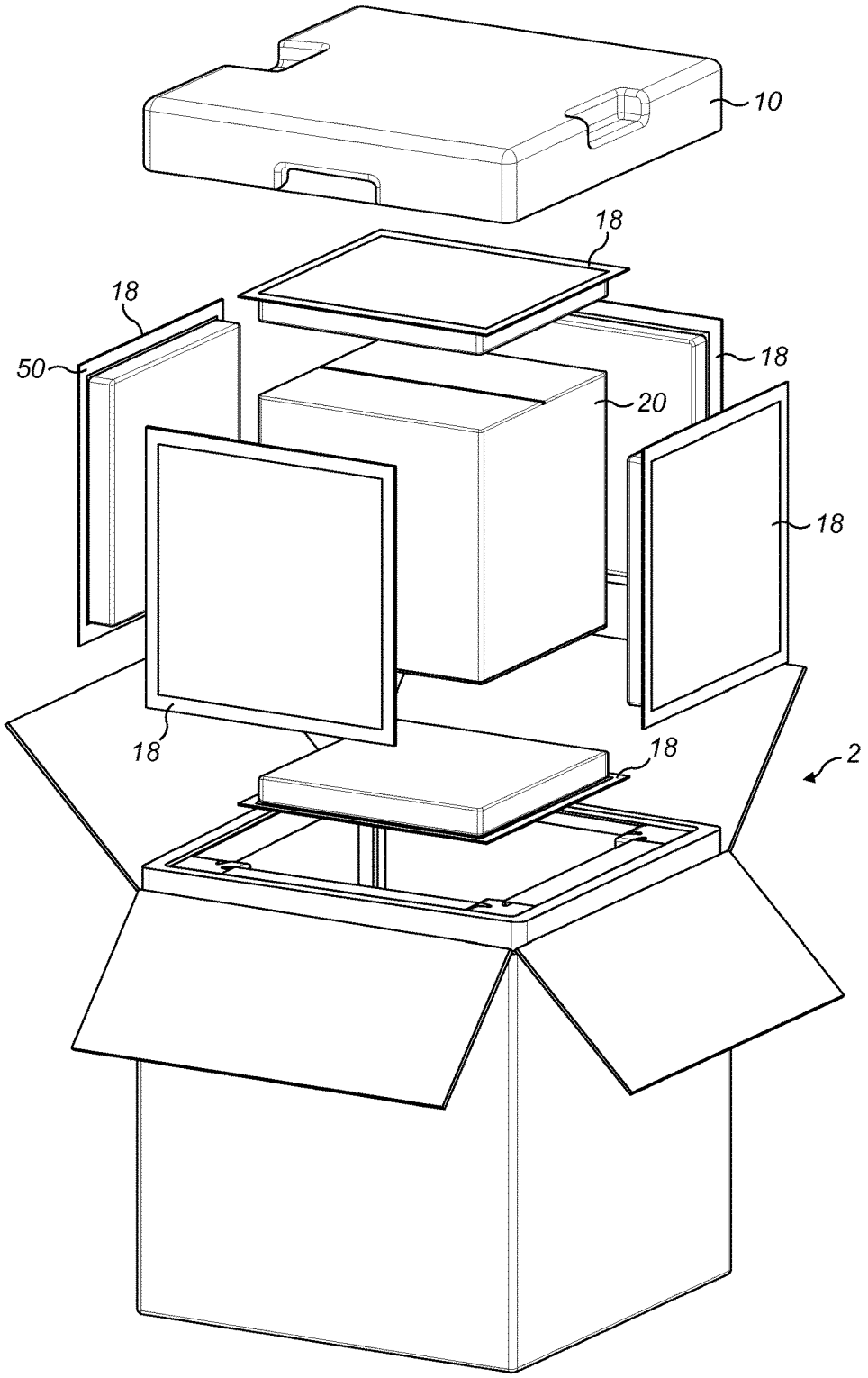
FIG. 2 is an exploded view of the package of FIG. 1, partially assembled.

As can be seen from, for example, FIG. 2, the PCM panel 18 has a peripheral flange 50 which extends generally co-planar with one face of the PCM panel 18. This flange 50 is formed from the encapsulating film material of the PCM panel 18 and is formed during the PCM panel manufacturing process.

The PCM panel 18 is preferably sized slightly smaller than the base wall pocket 26 such that there is sufficient space around the periphery of the PCM panel 18 to allow the flange 50 to flex upwardly as the PCM panel 18 is inserted into the pocket 26. This flange 50 will help locate the PCM panel in the pocket 26.

The various PCM panels 18 of this embodiment are all of the same shape and size in this embodiment, but depending on the shape of the payload, the PCM panels 18 may be of different shapes and sizes.

The recesses 48 provided in the base wall pocket 26 allow a user to insert his or her fingers under the vacuum insulated panel 12 and PCM panel 18 in order to remove the panel from the pocket 26.

Figure 3:
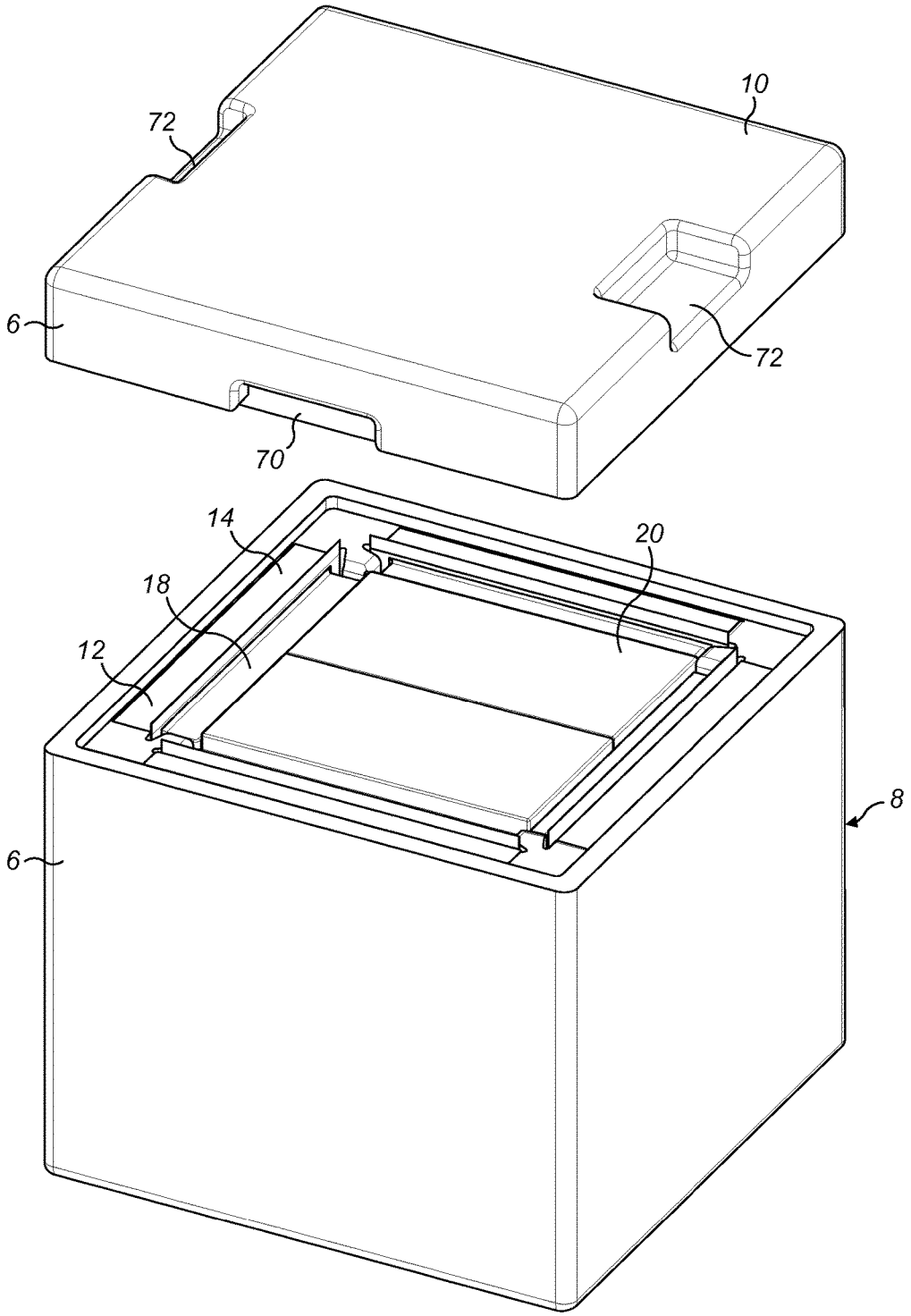
FIG. 3 shows the package of FIG. 1 with its outer carton removed and ready for closing.

Turning to the side wall pockets 28, as can be seen from for example FIG. 3, these each receive, from back to front, a vacuum insulated panel 12, a vacuum insulated panel protection element 14 and a PCM panel 18.

Figure 10:
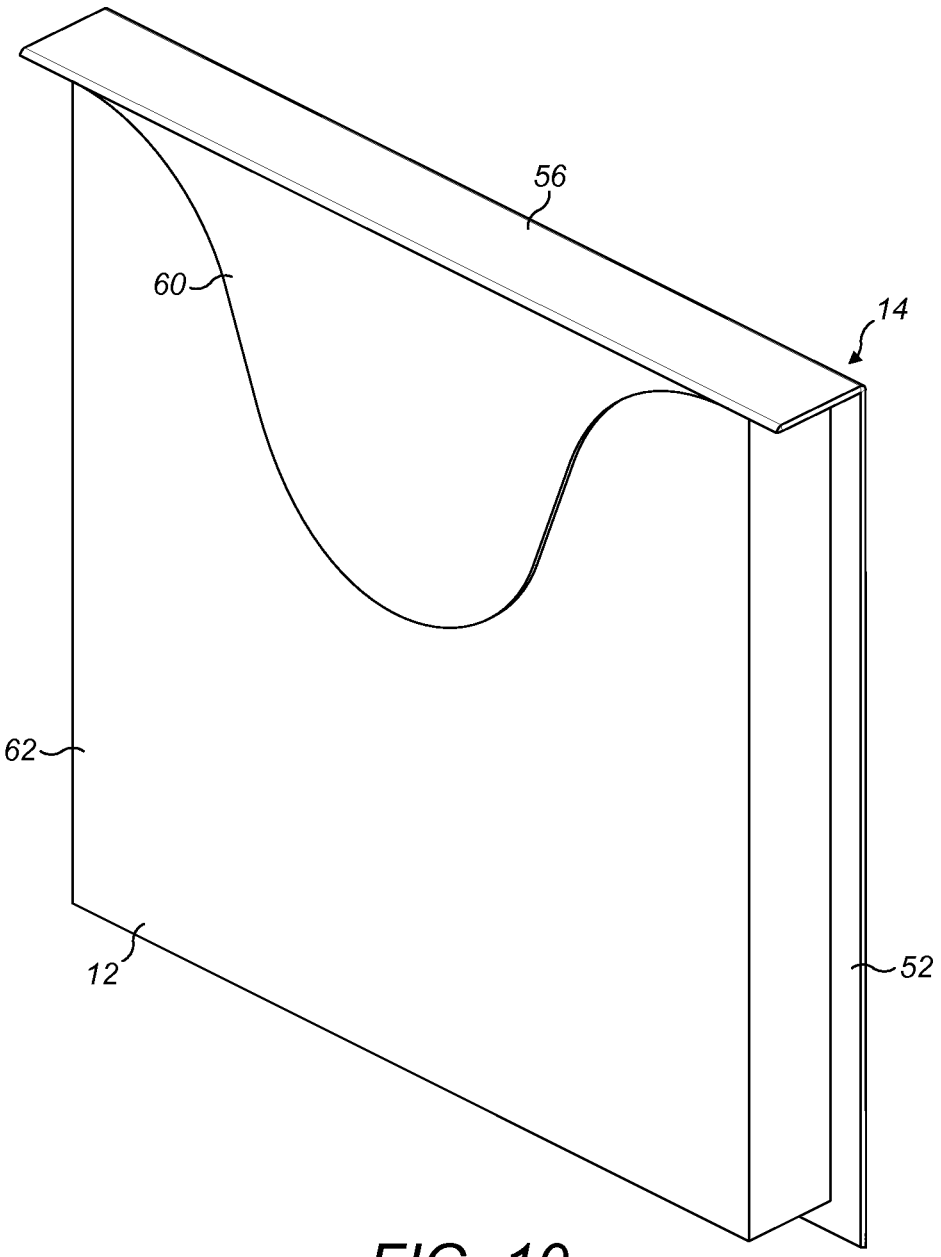
FIG. 10 shows an assembled vacuum insulated panel and protection element.

As discussed above, the vacuum insulated panel 12 and the PCM panels used in this embodiment are the same as those used in the base wall 22 and the lid 10. However, the vacuum insulated panel protection element 14 is different from those used in the base wall 22 and the lid 10. The vacuum insulated panel protection element 14 can be seem most clearly in FIG. 10 where it is shown in position around a vacuum insulated panel 12. The vacuum insulated panel protection element 14 is made from a corrugated board material, for example E (2 mm) flute or B (3 mm) flute corrugated board with a foil e.g. a metallised film, and/or waterproof plastics coating on one or preferably both sides. The element 14 has a first panel 52 which covers the front face 54 of the associated vacuum insulated panel 12 and extends beyond the lateral and bottom edges thereof. Hingedly attached to the first panel 52 is a second panel 56 which covers the upper edge 58 of the vacuum insulated panel 12. Hingedly attached to the second panel is a third panel 60 which extends over only an upper part of the rear face 62 of the vacuum insulated panel 12.

The vacuum insulated panel protection element not only acts to protect the vacuum insulated panel 12 in situ in the package 2, but also facilitates its handling. Specifically, a user can fold the vacuum insulated panel protection element 14 around the vacuum insulated panel 12 and then grip the vacuum insulated panel 12 between the first and third panels 52, 60 for assembly of the vacuum insulated panel 12 into the package 2.

Moreover, as can be seen from FIG. 5, for example, the vacuum insulated panel protection element 14 also acts to help retain the vacuum insulated panel 12 in the side wall pocket 28. The portion 64 of the vacuum insulated panel protection element 14 which projects beyond the vacuum insulated panel 12 engages in the slots 40 formed in the corner posts 32. The lower projecting part will engage in the slot 42 formed in the base wall 28. Thus, even though the vacuum insulated panel 12 may be a slight push fit in the side wall pocket 28, the vacuum insulated panel protection element also helps retain the vacuum insulated panel 12 in position.

The vacuum insulated panel 12 and vacuum insulated panel protection element 14 may be assembled into the pocket 28 from the top of the pocket 28. Alternatively, they may be assembled consecutively. In that case the vacuum insulated panel 12 may be slid into the pocket 28 from above or pushed in from the open face of the pocket 28, and the vacuum insulated panel protection element 14 then slid into the slot 40.

It will be understood that, when assembled, the third panel of the vacuum insulated panel protection element 14 is received within the recess 46 formed in the base wall of the pocket 28. The recess 46 is of substantially the same shape and depth as the third panel 60. This allows the major part of the rear surface 62 of the vacuum insulated panel 12 to closely engage the rear wall of the side wall pocket 28.

The side wall pockets 28 also receive the PCM panels 18. It will be seen again from FIG. 5 that the peripheral flange 50 of the PCM panel 18 is received in the slots 40 formed in the corner posts 32. The lower edge of the flange 50 will be received in the base wall slot 42. This interengagement of the flange 50 within the slots 40, 42 helps retain the PCM panels 18 within its side wall pocket 28. In assembly, the PCM panel 18 may simply be slid into position from above.

The PCM panels 18 are dimensioned such that after assembly they will lie generally flush with or project slightly beyond the faces of the corner posts 22.

As can be understood from FIG. 5, when the base wall pocket 26 and side wall pockets 28 have been filled with the appropriate vacuum insulated panels 12, vacuum insulated panel protection elements 14, 16 and PCM panels 18, the payload container 20 may be placed in the payload space defined between the PCM panels 18. The corners of the payload container 20 may engage tips 64 of the corner posts 22 for location purposes. The payload container 20 is preferably of a board material, particularly a corrugated board material, which may be provided on one or preferably both surfaces with a foil, for example a metallised film coating and/or with a waterproof plastics coating, the latter to protect from any moisture which may accumulate in use.

When the payload container is positioned within the payload space, the lid 10 of the package 2 may be fitted.

The lid 10 is also moulded from a foam material, preferably the same foam material as the main body 8. As can be seen in FIG. 3 for example, it has opposed handle cut outs 70 and recesses 72 for receiving for example an RFID tag or other logging device. The external container 4 has handling openings aligned with the handle cut outs 70.

Figure 8:
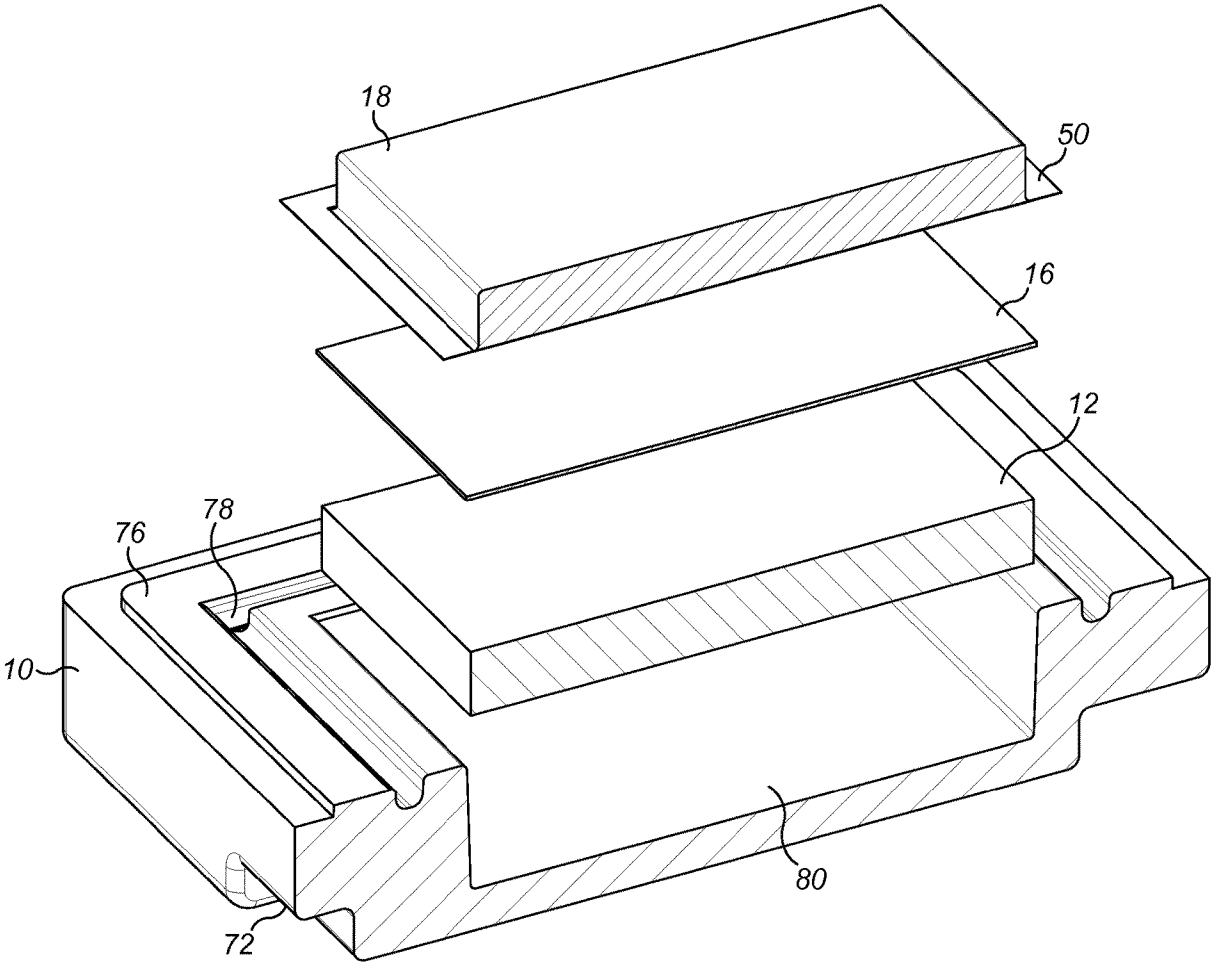
FIG. 8 shows an exploded view of the lid of FIG. 7.
Figure 9:
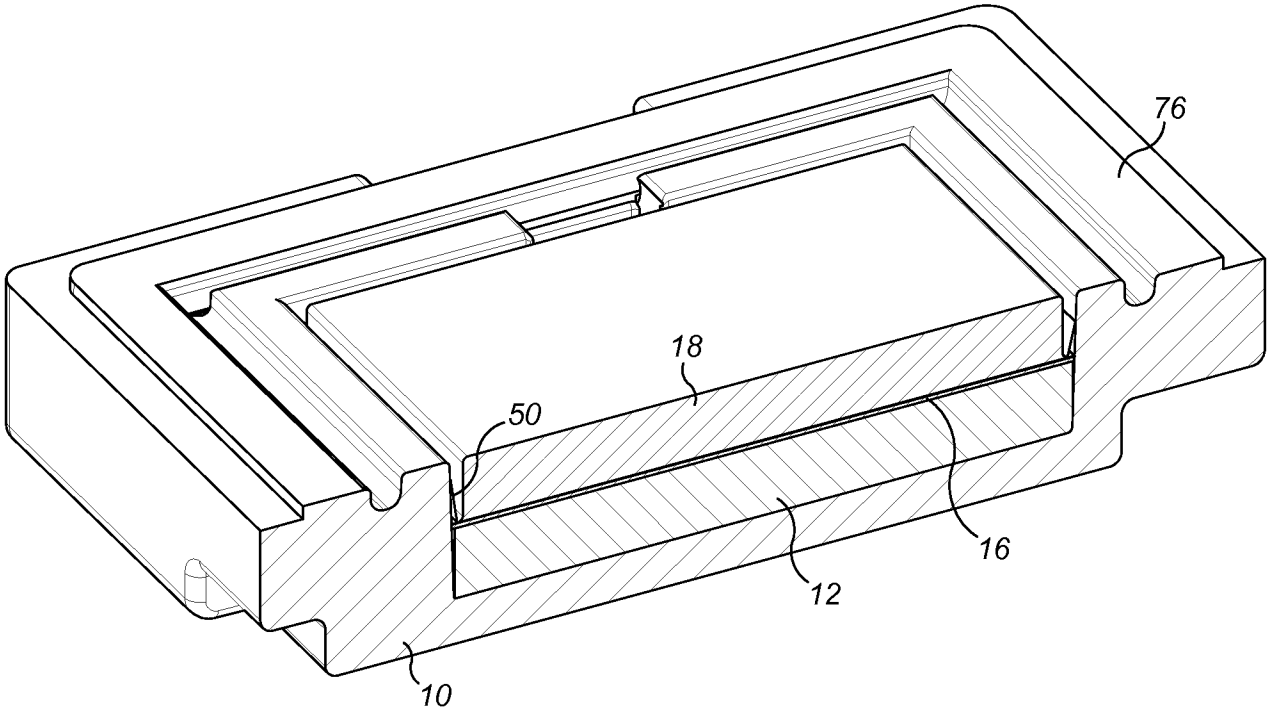
FIG. 9 shows the lid with the components mounted therein.

As shown in FIGS. 7 to 9, the lid 10 has a depending land 76 which extends around its entire periphery and which locates within the lip 34 of the main body 8. The land 76 is provided with a relief groove 78 which receives the upwardly projecting flanges 50 of the PCM panels 18 mounted in the side wall pockets 28. The lid 10 also has a pocket 80 for receiving a vacuum insulated panel 12, vacuum insulated panel protection element 16 and PCM panel 18. The vacuum insulated panel 12 may be a tight fit within the pocket 80. The vacuum insulated panel protection element is the same as that provided in the base wall 22. The PCM panel 18 is sized such that the flange 50 thereof will fold inwardly as the PCM panel 18 is inserted into the pocket 80 whereby, as shown in FIG. 9, the flange 50 will tend to splay outwardly into the walls of the pocket 80 to assist in retaining the PCM panel 18 in the pocket. Specifically, the lower edge of the folded down flange 50 will tend to dig into the walls of the pocket 80 to provide resistance to the PCM panel falling out of the pocket 80.

As illustrated in FIG. 6, the lid 10 is also provided with opposed recesses 82 which will allow a user to insert his or her fingers under the PCM panel 18 and the vacuum insulated panel 12 to facilitate their removal.

With the lid 10 positioned on the main body 8, the external container 4 may be closed for shipping.

It will be understood that after use, the package 2 may be reused, the PCM panels 18 being suitably reconditioned. The other components may be reused substantially as they are.

The above description relates to just one embodiment of the invention. However, it will be appreciated that modifications may be made to that embodiment without departing from the scope of the invention.

For example, as discussed above, the various panels need not be square but could be rectangular. Also, the package need not be cubic, but could be a rectangular cuboid in shape.

Figure 11:
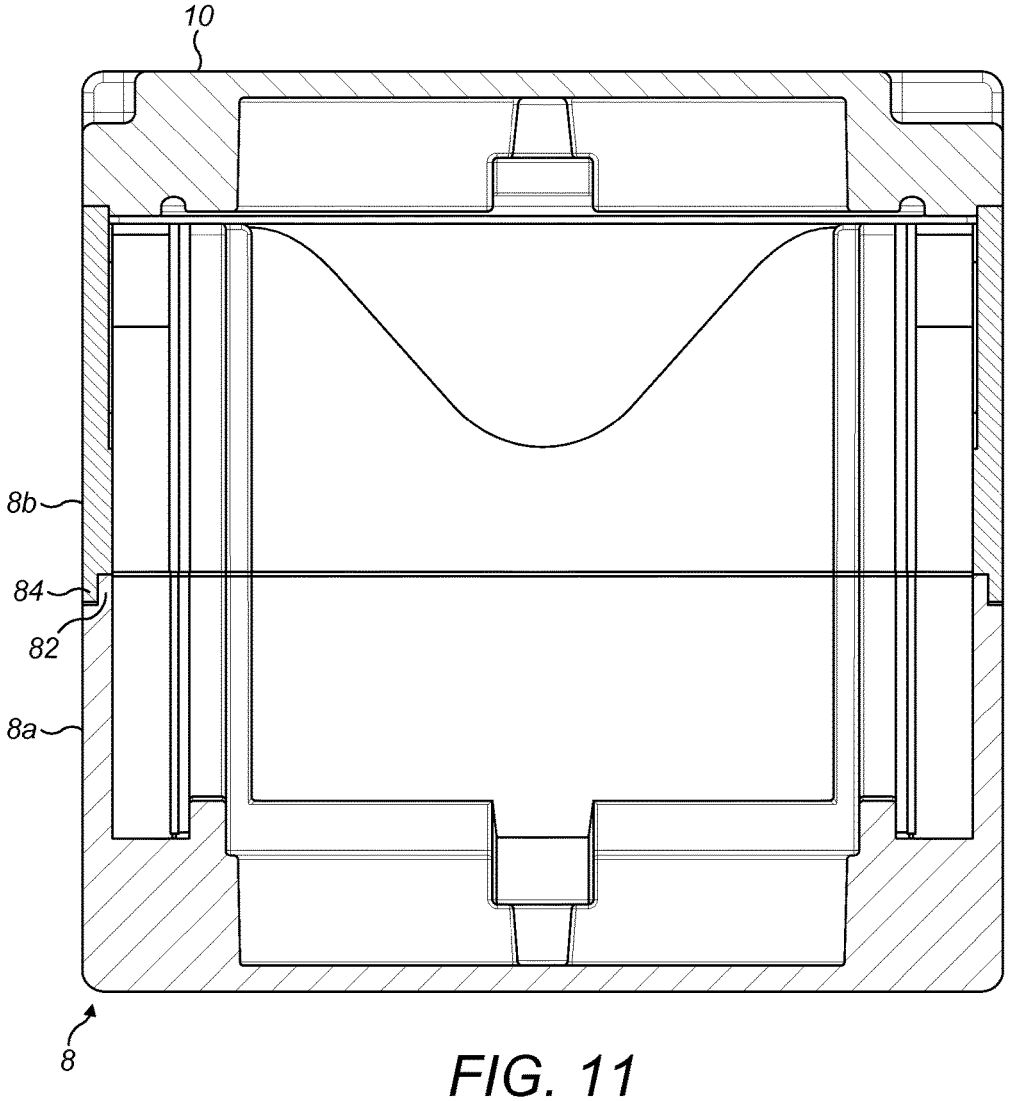
FIG. 11 shows a cross section through an alternative embodiment of the invention.

Also, depending on the size of the container, the manufacture of the main body 8 may be simplified by forming it in two or more parts. Such an arrangement is illustrated in FIG. 11.

In this construction the main body 8 is formed from a base part 8*a* and an annular upper part 8*b*. The base part 8*a* has an upstanding lip 82 which receives a depending lip 84 of the upper part 8*b*. The upper part 8*b* receives the lid 10 as in the earlier embodiment. The shapes of the pockets 26, 28, 80 are unchanged from the earlier embodiment and the same vacuum insulated panels 12, protection elements 14, 16 and PCM panels 18 are used. This construction is useful for larger packages where mould size restriction may not allow the full height of the main body 8 to be formed in a single operation.

Figure 12:
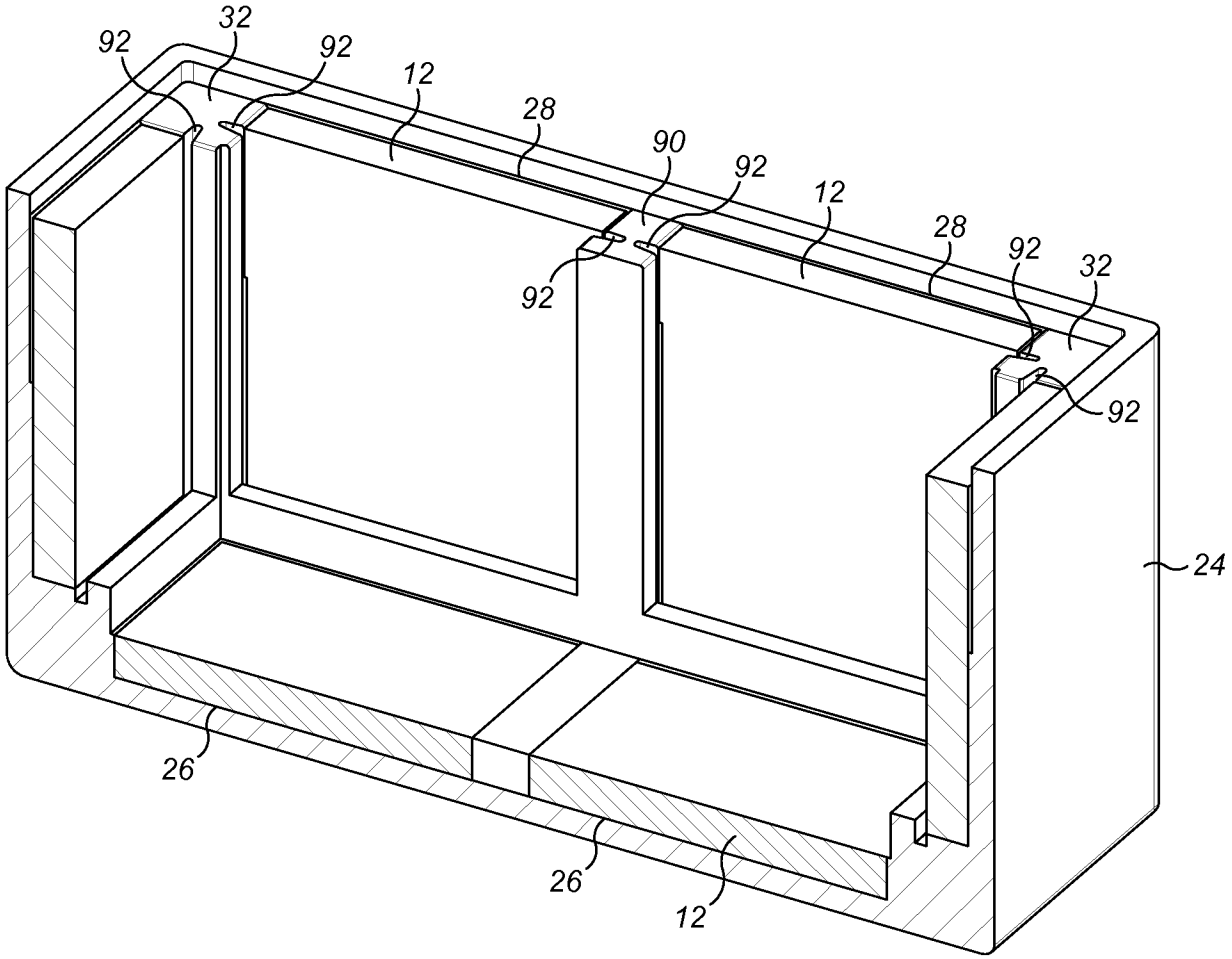
FIG. 12 shows a cutaway view of another package in accordance with the invention.

It will also be understood that more than one pocket 26, 28, 80 may be provided in one or more of the side walls 24, base wall 22 and lid 10. Such an embodiment is illustrated in FIG. 12.

In this embodiment, each side wall 24 is provided with two side wall pockets 28, separated by a rib 90. Opposed faces of the rib 90 are provided with slots 92 for receiving the vacuum insulated panel protection element 14 and flanges 50 of the PCM panels 18. The base wall 24 and lid 10 are provided with four pockets 28, 80.

Of course, the number of pockets provided on each wall may be varied to give a package of the desired dimensions. For example, if a rectangular container is required, the respective side walls 24 may each have different numbers of pockets 28.

Figure 13:
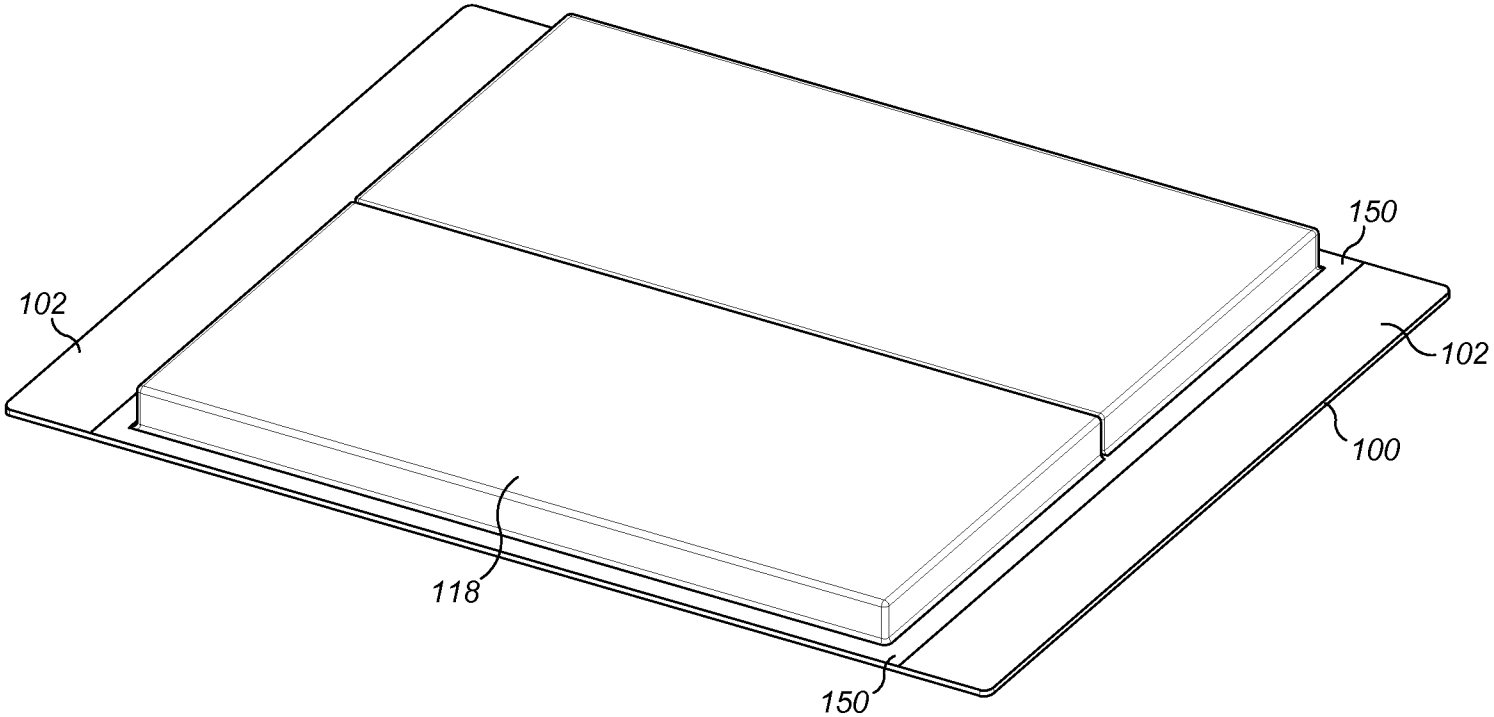
FIG. 13 shows a PCM panel for use in an embodiment of the invention.

It will also be appreciated that each PCM panel 18 may contain more than one PCM element. For example two or more PCM elements may be received one above the other in the side wall pockets 28. To facilitate such a construction, a plurality of PCM elements may be mounted to a common support, as shown in FIG. 13.

In this embodiment, two PCM elements 118, each having a peripheral flange 150, are mounted, e.g. bonded, to a support member 100. The support member 100 may be a sheet material such as cardboard, corrugated cardboard or corrugated plastics, and it has a peripheral flange 102 on at least one pair of opposed side edges which receive the flanges 150 of the PCM elements 118. This flange 102 may be received within the slots 40 provided in the side wall pockets 28 to assist in supporting the PCM elements 118.

In a yet further modification, the materials of the outer shell 6 and the panels 12 may be chosen so as to provide a desired thermal conductivity. In particular, the insert panels 12 may be made from a material which has a lower coefficient of thermal conductivity than that of the outer shell 6.

Thus the outer shell 6 may be made from expanded polystyrene (EPS) which typically has a thermal conductivity of about 0.036 W/m-K, graphite impregnated EPS (e.g. Neopor®) which typically has a thermal conductivity of about 0.032 W/m-K, EPS with a polyethylene additive (e.g. Arcel®) which typically has a thermal conductivity of about 0.038 W/m-K, or polyurethane (PUR) which typically has a thermal conductivity of about 0.022 W/m-K. In the case of an EPS based outer shell material, the insert panel 12 may be PUR which, as can be seen has a lower coefficient of thermal conductivity. In the case of any of the outer shell materials used, the insert panels 12 may be a Nano porous material such as BASF Slentite® which typically has a thermal conductivity of about 0.016 W/m-K. A typical vacuum insulated panel will typically have a thermal conductivity of about 0.004 W/m-K. Thus the materials of the outer shell 6 and the thermal insulation insert panels 12 may be chosen to give the desired thermal conductivity.

Such embodiments may use any of the constructional features described above, the only difference lying in the nature of the materials used.

The invention claimed is:

1. A thermally insulated package comprising:

a thermally insulating shell of a foam material, the shell comprising a plurality of walls and a plurality of corner post, each respective one of the corner posts being fixed to a respective pair of the walls at a corner of the shell, one or more of the walls each providing a back surface of an open topped pocket defined between two corresponding ones of the corner posts, each of the two corresponding ones of the corner posts having a surface facing the pocket, the surface of at least one of the two corresponding ones of the corner posts having a slot formed therein, and the pocket having an open side facing toward a center of the shell; and a phase change material (PCM) panel comprising a peripheral flange configured to be slidably inserted in the slot while each of the corner posts remains fixed to the respective pair of the walls;

wherein, when the peripheral flange is in the slot, the PCM panel is arranged at least partially within the pocket and is selectively removable from the pocket while each of the corner posts remains fixed to the respective pair of the walls; and wherein the shell defining a payload volume that is bordered by the PCM panel when the peripheral flange of the PCM panel is in the slot, and wherein the open side of the pocket is open to the payload volume.

2. A thermally insulating package as claimed in claim 1, wherein the PCM panel comprises a phase change material sealed within a foil or film pouch, the flange extending at least partially around a periphery of the panel.

3. A thermally insulating package as claimed in claim 1, wherein the flange extends around all sides of the PCM panel.

4. A thermally insulating package as claimed in claim 1, wherein the flange of the PCM panel is formed as an extension of one face of the panel.

5. A thermally insulating package as claimed in claim 1, wherein the PCM panel is arranged to project out from the pocket(s) formed in the walls of the outer shell, to be generally flush with the surface of the pocket, or be recessed slightly therein.

6. A thermally insulating package as claimed in claim 1, wherein the flange extends along two opposite sides of the PCM panel.

7. A thermally insulating package as claimed in claim 1, wherein the flange extends along a plurality of sides of the PCM panel.

8. A thermally insulating package as claimed in claim 1, wherein the PCM panel is selectively removable from the pocket through an open top end of the pocket.

9. A thermally insulating package as claimed in claim 1, wherein each pocket has a bottom side edge that faces an open top end of the pocket, and wherein the slot is included in the bottom side edge.

10. The thermally insulated package of claim 1, wherein the slot is centrally located on the surface of the corner post in which it is formed.

11. The thermally insulated package of claim 1, wherein the slot is spaced apart from the wall that provides the back surface of the pocket defined between the two corresponding ones of the corner posts in which it is formed.

12. The thermally insulated package of claim 1, wherein the surface of each of the two corresponding ones of the corner posts face each other.

13. The thermally insulated package of claim 1, wherein the PCM panel is entirely spaced apart from the wall providing the back surface of the open topped pocket in which the PCM panel is received to define a space between the wall and the PCM panel when the PCM panel is inserted in the slot.

14. The thermally insulated package of claim 1, wherein the PCM panel is configured to be removable from the pocket through an open top end by sliding the flange out of the slot.

15. The thermally insulated package of claim 1, wherein the flange of the PCM panel is configured to slide into the slot from an open top end above the pocket.

16. A thermally insulated package comprising:

a thermally insulating shell of a foam material, the shell comprising a plurality of walls and a plurality of corner post, each respective one of the corner posts being fixed to a respective pair of the walls at a corner of the shell, one or more of the walls each providing a back surface of an open topped pocket defined between two corresponding ones of the corner posts, each of the two corresponding ones of the corner posts having a surface facing the pocket, the surface of at least one of the two corresponding ones of the corner posts having a slot formed therein, and the pocket having an open side facing toward a center of the shell; and a phase change material (PCM) panel comprising a peripheral flange configured to be slidably inserted in the slot while each of the corner posts remains fixed to the respective pair of the walls;

wherein, when the peripheral flange is in the slot, the PCM panel is arranged at least partially within the pocket and is selectively removable from the pocket while each of the corner posts remains fixed to the respective pair of the walls; and wherein the shell is free of insulating material between the PCM panel and the payload volume when the peripheral flange of the PCM panel is in the slot.

* * * * *